US006475069B1

(12) United States Patent
Thomas et al.

(10) Patent No.: US 6,475,069 B1
(45) Date of Patent: Nov. 5, 2002

(54) CONTROL OF REMOVAL RATES IN CMP

(75) Inventors: Terence M. Thomas, Newark, DE (US); Qianqiu (Christine) Ye, Wilmington, DE (US); Joseph K. So, Newark, DE (US); Peter A. Burke, Avondale, PA (US)

(73) Assignee: Rodel Holdings, Inc., Wilmington, DE (US)

( * ) Notice: Subject to any disclaimer, the term of this patent is extended or adjusted under 35 U.S.C. 154(b) by 72 days.

(21) Appl. No.: 09/693,211

(22) Filed: Oct. 20, 2000

Related U.S. Application Data

(60) Provisional application No. 60/161,242, filed on Oct. 22, 1999.

(51) Int. Cl.[7] ..... B24B 1/00
(52) U.S. Cl. ..... 451/57; 451/288; 451/59
(58) Field of Search ..... 451/57, 59, 37, 451/53, 28, 29, 285–289, 41; 216/89, 88; 156/636.1

(56) References Cited

U.S. PATENT DOCUMENTS 5,540,810 A * 7/1996 Sandhu et al. ..... 156/636.1
5,676,587 A * 10/1997 Landers et al. ..... 451/57
5,681,205 A * 10/1997 Yam ..... 451/39

* cited by examiner

*Primary Examiner*—Lee Wilson
(74) *Attorney, Agent, or Firm*—Gerald K. Kita; Kenneth A. Benson

(57) ABSTRACT

A method for CMP polishing with a first step slurry composition selective to a metal in a metal layer to remove the metal at a high removal rate during polishing, and a second step slurry composition selective to a barrier film and least selective to either of an underlying dielectric layer or a metal interconnection structure in the dielectric layer, to remove the barrier film at a high removal rate during polishing, and level a surface of the dielectric layer to the surface of the interconnection structure.

9 Claims, No Drawings

CONTROL OF REMOVAL RATES IN CMP

CROSS REFERENCE TO RELATED APPLICATION

This application claims the benefit of U.S. Provisional Patent Application Serial No. 60/161,242 filed Oct. 22, 1999.

FIELD OF THE INVENTION

The invention pertains to polishing methods and slurry compositions or formulations that are used in polishing a semiconductor substrate having successive layers, comprised of, a metal layer, an underlying barrier or liner film, and an underlying dielectric layer having imbedded metal interconnect structures.

BACKGROUND OF THE INVENTION

Landers et al. in U.S. Pat. No. 5,676,587 discloses a two-step polishing process for polishing a semiconductor substrate. The first step utilizes CMP polishing with an alumina based slurry to remove a metal layer from an underlying barrier film. The second step utilizes CMP polishing with a silica-based slurry to remove the barrier film of Ta, TaN, Ti, or TiN. The silica-based slurry is pH neutral and is selective to Ta, TaN, Ti, or TiN to remove the barrier film.

While polishing a semiconductor substrate by CMP, it is critical to maintain the cross section and planarity of underlying conducting metal interconnect structures that provide metal circuit interconnect lines for a semiconductor structure, especially when polishing to attain high removal rates of the various layers. Excessive removal of the metal from the conducting metal lines is observed as cavities (known as "dishing"), which is undesirable, since optimal electrical performance is obtained when adequate metal for the conducting metal lines remains without being removed by polishing. Excessive removal of the $SiO_2$ dielectric layer within the underlying metal lines is observed as cavities (known as "erosion"), which is undesirable, since the dielectric layer should be flawless, free of cavities, adjacent to side geometry of the metal lines. Further, the polishing operation is required to polish the semiconductor substrate with a smooth planar polished surface on which are manufactured successive layers, which themselves are polished by CMP. Excessive dishing in the metal lines and excessive erosion in the dielectric layer comprise defects in the smooth planar polished surface.

A need exists for a method of polishing by CMP to attain high removal rates of both the metal layer and the barrier film, while minimizing dishing and erosion in the polished surface.

SUMMARY OF THE INVENTION

A method according to the invention provides a two step polishing process that includes, a first step of polishing a semiconductor substrate with a slurry composition selective to removal of copper during polishing, which removes a metal layer from an underlying barrier film, followed by a second step of polishing with a slurry formulation selective to removal of the barrier film and less selective to removal of copper, which removes the barrier film from an underlying dielectric layer and polishes the dielectric layer having copper metal lines therein with a smooth planar polished surface.

The method according to the invention further uses slurry compositions that are selective to removal of a metal in a metal layer during polishing of a semiconductor substrate by CMP, and a second slurry composition that is selective to removal of the barrier film, and less selective to removal of the metal providing metal lines in a dielectric layer that underlies the barrier film.

DETAILED DESCRIPTION OF THE EMBODIMENTS

The invention provides a method of CMP polishing a semiconductor substrate having a metal layer, an underlying barrier film, and a dielectric layer having imbedded metal interconnect structures. This method is applicable to any metal interconnect structure containing: a conductive metal (such as Cu, Al, W, Pt, Pd, Au, or Ir), a barrier or liner layer (such as Ta, TaN, Ti, TiN, or TiW), and an underlying ILD structure (such as $SiO_2$, TEOS, PSG, BPSG, or any low-K dielectric).

In an embodiment, polishing of a structure containing a Cu layer, an underlying Ta or TaN barrier layer, and a $SiO_2$ dielectric layer, using a two-step process is described. In the first step, the Cu overburden of excess metal is removed while removing minimal amounts of the Ta/TaN liner or $SiO_2$. The slurry used in the first step of this process is one that can remove the copper metal overburden covering the semiconductor structure, and has very low rate of material removal on the Ta/TaN barrier film layer and underlying $SiO_2$ layer. Typically, this slurry would be alumina based, exhibit an acidic pH, and contain oxidizers that would enhance the chemical-mechanical removal of Cu at accelerated rates (above 2000 A/min).

For the second step suitable planarity has been obtained when using a slurry whose pH is basic and which gives the following range of removal rates for the various layers in the structure. These ranges may vary depending on the composition of the barrier layer and how it is formed, the metal layer and how it is formed, and the particular dielectric layer employed. Method 1 in Table A refers to a second step method trial that was performed, and shows high barrier removal rates while metal and dielectric removal rates remain low. Method 2 in Table A refers to a second step method trial that was performed, and shows high barrier removal rates while metal removal rates are moderate (between high and low) and a low dielectric removal rate.

TABLE A

| METHOD | TaN RR (A/min) | Ta RR (A/min) | Cu RR (A/min) | $SiO_2$ RR (A/min) |
|---|---|---|---|---|
| 1 | >700 | >400 | <150 | <250 |
| 2 | >700 | >400 | <150–400 | <250 |

The two methods trials of Table A have been found to give good planarity without significant dishing or erosion. Method trial 1 utilized a slurry that is selective to the barrier film and to high removal rates of Ta or TaN, and which is least selective to other materials, to provide the first method trial with desired minimized removal rates of both Cu and $SiO_2$. This method trial should be used when an insignificant film of very little Cu overburden remains after first-step polishing. The Cu overburden is removed without significant polishing, and the slurry allows for rapid and complete removal of the Ta barrier layer, with low removal rate of CU such that there is significantly reduced removal of the Cu interconnect structures to minimize flaws produced by polishing. Further, slurry is selective to the $SiO_2$ with a higher selectivity than a minimized selectivity, such that the $SiO_2$ will be removed during second step polishing with a higher rate of removal than a minimized rate of removal, to become reduced in height to have a surface at the same level of the surface level of the Cu interconnect structures that have undergone dishing and concavity during first step polishing with a slurry with high selectivity to Cu that provides a high Cu removal rate.

The second method trial utilizes a slurry with significantly maximized or higher removal rates of Ta or TaN, and a minimized lower removal rate of $SiO_2$. The slurry is selected for a selectivity for Cu that is higher than a minimized selectivity, to use when polishing to provide a corresponding higher rate of removal of CU than a minimized rate of removal of Cu, to remove spots of Cu that are present on the barrier film of Ta or TaN due to incomplete removal of the Cu by the first step polishing. This method should be used when some Cu overburden remains after stopping the first step polishing. This allows for the removal of any spots of Cu remaining on the wafer, complete and rapid removal of the Ta or TaN barrier layer, and minimized removal of the underlying $SiO_2$ layer to level the $SiO_2$ layer at the same level with a surface level of the interconnection structure.

With the proper application of the above methods, interconnect structures in semiconductor substrates can be produced with low observed dishing or recess of the interconnect structures (in particular, Cu) as well as low erosion of the underlying dielectric layer (i.e., $SiO_2$). An advantage of these methods is that, the second step slurry is selected to compensate for any dishing, by selecting a slurry with an increased selectivity to $SiO_2$, which removes the $SiO_2$ to the level of the Cu interconnect structures that have undergone dishing during the first step polishing. When the first step polishing is performed with a slurry composition that is selective to Cu metal, the circuit interconnect structures are subject to dishing. Another advantage of these methods is that, the second step slurry is selected to remove spots of Cu metal layer on the barrier film, caused by deficient removal of the copper metal layer by the first step polishing, by selecting a slurry with a relatively increased or higher selectivity to Cu, which removes the Cu metal remaining on the barrier film due to incomplete Cu removal by the first step polishing.

It has been determined that, through the addition of certain additives in specific amounts, the removal rates of Cu, Ta or TaN, and $SiO_2$ can be controlled in order to produce the removal rates described in the methods trials discussed above. In one embodiment, the complexing agent is malic acid, tartaric acid, gluconic acid, glycolic acid, citric acid, phthalic acid, pyrocatecol, pyrogallol, gallic acid, or tannic acid. Suitably, the complexing agent is citric acid. Complexing agents may be used in the compositions of the present invention individually or in combinations of two or more. Embodiments of complexing agents of the present invention will tend to complex with metal anions, forming a 5 or 6 member ring, whereby the metal atom forms a portion of the ring.

It has also been found that enhanced barrier removal (e.g., tantalum nitride) can be achieved by increasing the presence of complexing agent. The complexing agents are present in concentrations of from about 0.01, 0.05, 0.1, 0.5, 1, 2, 3, 4, 5, 6, 7, 8, 9, to 10 weight percent, suitably about 0.1, 0.2, 0.3, 0.4, 0.5, 0.6, 0.7, 0.8, 0.9, 1, 1.1, 1.2, 1.3, 1.4, to 1.5 wt.%, and suitably about 0.1, 0.2, 0.3, 0.4, 0.5, 0.6, 0.7, 0.8, 0.9, to 1wt. %. To achieve enhanced barrier removal rates, the complexing agent is present in about 0.1, 0.2, 0.3, 0.4, 0.5, 0.6, 0.7, 0.8, 0.9, to 1wt. %, suitably about 0.3, 0.4, 0.5, 0.6, 0.7, 0.8, 0.9,to 1wt. %, and suitably about 0.9 to 1wt. %.

In each method trial, a Ta removal rate above 400 A/min and a TaN removal rate above 700 A/min is desired. Removal of Ta/TaN is enhanced at alkaline pH ranges: therefore, all slurries discussed are in a pH range above 7, and in a range of above 7 pH to 11 pH. The silica is of the type of silica in an alkaline pH having a Zeta potential of negative 20 millivolts or greater at the pH of use, i.e. pH>7, where the Zeta potential is the measure of surface charge density of the silica particle in dispersion in an aqueous solution of alkaline pH. It has been found that silica particles in dispersion in a solution of neutral pH will gel, and ruin the desired flowability of the polishing slurry during polishing. Silica is disclosed as being suitable. And any metal oxide (e.g., alumina, titania, zirconia, etc.) or abrasive particle with suitably low particle size (<1 micron) and appropriate Zeta value would be suitable.

EXAMPLE 1

Polishing of 6" wafers containing Cu, TaN, and $SiO_2$ (TEOS) films was completed on a CWESTECH 372U polisher (available from IPEC/Planar). An IC1000 XY-grooved primary polishing pad, a Politex Regular Embossed secondary polishing pad, and a DF200 carrier film were used. (all available from Rodel, Inc.). A TBW 100 Grit Diamond conditioner was employed. The IC grooved pad was mounted to the primary platen and 20 precondition sweeps were carried out with DI water. The Politex pad was mounted to the secondary table and preconditioned with the 6" stiff bristle stiff bristle hand brush and DI water hand sprayer, 8 scrapes, and 8 brushes. The conditioning parameters were 7 psi DF, 3 platen sweeps (post with DI Water), 70 rpm platen speed, and 75 rpm disk speed. The following polishing parameters are used (depending on the tested substrate):

TABLE 1

| Parameter | Phase 1 | Phase 2 |
|---|---|---|
| Time (seconds) | 60 | 10 |
| DF (psi) | 2 | 0.5 |
| Back Press. (psi) | 1 | 0 |
| DF Ramp (sec) | 5 | 5 |
| Carrier (rpm) | 60 | 40 |
| Table (rpm) | 60 | 40 |
| Slurry Flow (ml/min) | 150 | 0 |
| Rinse | Off | On |

For primary polish on sheet wafers, Cu is 120 seconds, TaN is 60 seconds and TEOS (i.e., silica) is 120 seconds.
Three Cu dummy wafers were run using control slurry (60 sec) followed by removal rate monitor wafers.
For each test slurry, 2 dummy oxide wafers were run followed by:
Cu = 60 seconds
TaN = 30 seconds
TEOS = 120 sec
Removal Rate analysis was performed using a 25-point polar measurement site map on the CDE and SM-300. Edge exclusion of 10 mm for W and 10 for TaN and TEOS.

TABLE 2

The following slurries were tested on 6" wafers containing Cu, TaN, and $SiO_2$ (TEOS).

| Slurry[1] | $HIO_3$ | CA | BTA | Particle Diameter (nm) | Colloidal Silica Conc. | pH |
|---|---|---|---|---|---|---|
| 1C | 0 | 0.192 | 0.1 | 12 | 8.5 | 8.0 |
| 4B | 0 | 0.192 | 0.1 | 12 | 8.5 | 8.5 |
| 4C | 0 | 0.192 | 0.1 | 12 | 8.5 | 9 |

TABLE 2-continued

The following slurries were tested on 6" wafers containing Cu, TaN, and $SiO_2$ (TEOS).

| Slurry[1] | $HIO_3$ | CA | BTA | Particle Diameter (nm) | Colloidal Silica Conc. | pH |
|---|---|---|---|---|---|---|
| 4D | 0 | 0.192 | 0.1 | 12 | 8.5 | 9.5 |
| 4E | 0 | 0.192 | 0.1 | 12 | 8.5 | 10 |
| 4F | 0 | 0.192 | 0.1 | 12 | 8.5 | 10.5 |

[1]All numbers are given in weight percentages. Water comprises the remaining weight of the slurries.
CA = citric acid.
BTA = benzotriazole.

TABLE 3

Observed Metal/Oxide removal rates (Å/min)

| Slurry | Cu | Thermal Oxide | TaN | Polishing Parameter (F/P/T/C) |
|---|---|---|---|---|
| 1C | 55 | 220 | 983 | 2/1/60/60 |
| 4B | 84 | 245 | 1260 | 2/1/60/60 |
| 4C | 86 | 140 | 1411 | 2/1/60/60 |
| 4D | 106 | 175 | 1126 | 2/1/60/60 |
| 4E | 123 | 187 | 1189 | 2/1/60/60 |
| 4F | 194 | 156 | 1305 | 2/1/60/60 |

F = Down Force
P = Back Pressure
T = Table Speed
C = Carrier Speed

It has been found that smaller submicron abrasive particles increase the selectivity of barrier (e.g., tantalum nitride) over oxide. Thus, when it is desirable for the second step slurry to have selectivity for barrier over oxide, then the submicron particle size is suitably less than 50 nm. In an embodiment, the average particle size of non-agglomerated submicron abrasive particles is from 10, 15, 20, 25, 30, 35, 40, to 45 nm, suitably from 10, 15, 20, to 25 nm, and from 10, 11, 12, 13, 14, to 15 nm, and from about 12nm.

The submicron abrasive particles in the compositions of the present invention may be comprised of any of the oxides used for chemical-mechanical polishing such as, alumina, silica, ceria, titania, and zirconia. Suitably the submicron abrasive particle is silica, suitably colloidal silica. Generally the total amount of abrasive particles used in slurries of the present invention is about 1, 2, 3, 4, 5, 6, 7, 8, 9, or 9.5% by weight. When the submicron abrasive particles are fumed silica, then they are suitably present at about 5, 6, 7, 8, 9, or 9.5% by weight, suitably about 8.5% by weight. When the submicron abrasive particles are colloidal silica, then they are present at about 5, 6, 7, 8, 9, or 9.5% by weight, or about 8, 8.1, 8.2, 8.3, 8.4, 8.5, 8.6, 8.7, 8.8, 8.9, or 9% by weight, or about 8.5% by weight.

Optionally a corrosion inhibitor, such as Benzotriazole, or BTA, may be added to the second-step slurries of this invention. These compounds are well known passivating agents for Cu, and has been demonstrated to be effective in inhibiting Cu removal rates during CMP polishing (Steigerwald, 1995). By the addition of BTA in very small amounts (between 0.0001 and 0.01 wt. %), passive corrosion of Cu is inhibited.

Metal interconnect structures, or features, on substrates are often around 5$\mu$. However, new technologies are allowing the size of features to decrease to about 0.18$\mu$. Such newer, smaller features will require more sophisticated and specialized slurries. The present method of polishing is suitably performed on a substrate with features of about 0.1, 0.15, 0.2, 0.25, 0.3, 0.35, 0.4, 0.45 to 0.5$\mu$. Suitably, the present method is performed on a substrate with features of less than 0.4$\mu$, suitably less than 0.3$\mu$, suitably less than 0.21$\mu$, and suitably about 0.18$\mu$.

Improvements in wafer manufacturing have led to an increase in feature density. Just as smaller features will require more specialized slurries, so will higher density features. The present method of polishing is suitably performed on a substrate containing tungsten features with a density of greater than 15%, suitably greater than 20%, and suitably greater than 25%. The present method of polishing is preferably performed on a substrate containing copper features with a density of greater than 90%, suitably greater than 95%, and suitably greater than 97%.

Substrates, which can be polished using slurries of the present invention, are comprised of silica and a layer of at least one metal selected from aluminum, copper, and tungsten. Often times a barrier layer or film is used between the aluminum, copper or tungsten and the silica. The barrier layer is preferably at least one layer comprised of titanium, titanium nitride, tantalum, and tantalum nitride. Alternatively, two different barrier layers can be used, preferably titanium/titanium nitride or tantalum/tantalum nitride. A preferred substrate is one wherein a copper layer is separated from the silica substrate via a tantalum layer. Another substrate is one wherein a copper layer is separated from the silica substrate via tantalum and tantalum nitride layers. Another substrate is one wherein a tungsten layer is separated from the silica substrate via a titanium layer. Another substrate is one wherein a tungsten layer is separated from the silica substrate via titanium and titanium nitride layers.

Although preferred embodiments are disclosed, other embodiments and modifications of the invention are intended to be covered by the spirit and scope of the appended claims.

What is claimed is:

1. A method for polishing a semiconductor substrate having a metal layer, an underlying barrier film and an underlying dielectric layer with metal interconnect structures, comprising-the steps of:

removing the metal layer by CMP first step polishing using a first step slurry that is highly selective to the metal of the metal layer and less selective to the barrier film to remove the metal of the metal layer with a maximized rate of metal removal by polishing, and to minimize removal of the barrier film, and removing the barrier film by CMP second step polishing using a second step slurry that is highly selective to the barrier film to remove the barrier film with a maximized rate of metal removal by polishing, while minimizing removal of either the metal layer or the dielectric layer to which said slurry is least selective, which provides the height of the dielectric layer at a surface level of the metal interconnect structures, and further, wherein the step of removing the barrier film by CMP second step polishing uses a second step slurry having a pH greater than 7.

2. The method as recited in claim 1, wherein the step of removing the barrier film by CMP second step polishing uses the second step slurry having a dispersion of colloidal silica of a Zeta potential of negative 20 millivolts or greater at said pH.

3. The method as recited in claim 1, wherein the step of removing the barrier film by CMP second step polishing uses the second step slurry having submicron abrasive particles of colloidal silica comprising less than 10% by weight of said second step slurry.

4. The method as recited in claim 1, wherein the step of removing the barrier film by CMP second step polishing uses the second step slurry having benzotriazole, and further having; citric acid as a complexing agent.

5. The method as recited in claim 1, wherein the step of removing the barrier film by CMP second step polishing uses the second step slurry having benzotriazole, and further having; citric acid as a complexing agent, and submicron abrasive particles of colloidal silica comprising less than 10% by weight of said second step slurry.

6. The method as recited in claim 1, wherein the step of removing the barrier film by CMP second step polishing uses the second step slurry having benzotriazole, and further having; citric acid as a complexing agent, and submicron abrasive particles of colloidal silica of less than 50 nanometers particle size comprising less than 10% by weight of said second step slurry.

7. The method as recited in claim 1, wherein the step of removing the barrier film by CMP second step polishing uses the second step slurry having benzotriazole, and further having; malic acid as a complexing agent.

8. The method as recited in claim 1, wherein the step of removing the barrier film by CMP second step polishing uses the second step slurry having benzotriazole, and further having; malic acid as a complexing agent, and submicron abrasive particles of colloidal silica comprising less than 10% by weight of said second step slurry.

9. The method as recited in claim 1, wherein the step of removing the barrier film by CMP second step polishing uses the second step slurry having benzotriazole, and further having; malic acid as a complexing agent, and submicron abrasive particles of colloidal silica of less than 50 nanometer particle size and comprising less than 10% by weight of said second step slurry.

* * * * *